US006869055B2

(12) United States Patent
Casiello Jr.

(10) Patent No.: US 6,869,055 B2
(45) Date of Patent: Mar. 22, 2005

(54) URINAL DRINK COASTER

(76) Inventor: Nick Frank Casiello Jr., 1449 Briergate Dr., Naperville, IL (US) 60563

( * ) Notice: Subject to any disclaimer, the term of this patent is extended or adjusted under 35 U.S.C. 154(b) by 0 days.

(21) Appl. No.: 10/096,393

(22) Filed: Mar. 9, 2002

(65) Prior Publication Data

US 2003/0168565 A1 Sep. 11, 2003

(51) Int. Cl.[7] ..... B56D 19/00
(52) U.S. Cl. ..... 248/346.11
(58) Field of Search ..... 248/346.01, 346.11, 248/346.5, 146, 213.2, 310, 311.2, 314, 219.2

(56) References Cited

U.S. PATENT DOCUMENTS 2,641,911 A * 6/1953 Raymond et al. ..... 215/394
2,652,703 A * 9/1953 Keegan ..... 65/53
3,357,590 A * 12/1967 Safford ..... 215/394
5,056,749 A * 10/1991 Ige ..... 220/630
5,465,891 A * 11/1995 Bridges ..... 220/636
D387,250 S * 12/1997 Tubbesing ..... D7/624
5,984,156 A * 11/1999 Bridges ..... 220/626
6,135,410 A * 10/2000 Harrison ..... 248/146
6,243,885 B1 * 6/2001 Lopez-Torres, Jr. ..... 4/300
2001/0013144 A1 * 8/2001 Lopez-Torres ..... 4/661
2002/0053572 A1 * 5/2002 Nordvik ..... 220/555
2002/0162934 A1 * 11/2002 Dawson ..... 248/346.11

* cited by examiner

*Primary Examiner*—Leslie A. Braun
*Assistant Examiner*—A. Joseph Wujciak
(74) *Attorney, Agent, or Firm*—Gregory B. Beggs

(57) ABSTRACT

A urinal drink coaster is a lightweight apparatus with a rigid body member formed from a lightweight, easily molded plastic material forming a cylinder with an interior wall dividing the cylinder in half. There are raised squares which the drink rest on and groves to allow drainage of liquid. The drink coaster is placed over the flushing devise on the urinal. The purpose for this coaster is to secure drinks while in the restroom as well as displaying advertisement on the circumference of the drink coaster.

4 Claims, 3 Drawing Sheets

URINAL DRINK COASTER

This invention relates to coasters used to hold drinks. More particularly it relates to coasters for holding bottles, glasses or cans in bar restrooms. The urinal drink coaster of this invention is placed over a urinal flushing device so that a patron can place his drink in the urinal drink coaster to prevent the drink from falling on the floor and spilling or breaking. The urinal drink coaster thereby provides a patron with a specific and more convenient place to put his drink.

BACKGROUND OF THE INVENTION

Bar establishment patrons normally take their drinks to the restrooms with them to prevent someone from taking them or putting something inside. At present, when entering the restroom, the patrons now place their drinks on the side of the urinal and have a tendency to slip off due to the moisture of the drink creating not only a slippery floor but a dangerous situation due to the broken glass.

This is a constant concern for the bar owners regarding the liability they face if a patron happens to stumble and fall on broken glass while using the restroom.

SUMMARY OF THE INVENTION

The urinal drink coaster of this invention utilizes an innovative design which allows the drink coaster to be reasonably secured to any of a multitude of urinal manual flushing devices. This drink coaster shape allows for convenient storage and easy handling.

Accordingly, it is an object of this invention to create a drink coaster which can be placed over any type of manual flushing device with a snug fit creating a level, secure and safe place to place a drink container such as a bottle, glass or can while utilizing the restroom area.

A further object of this invention is to create a drink coaster that is reliable, easy to use, durable and inexpensive to manufacture.

A further object of this invention is to create a drink coaster to prevent a drink container from slipping onto the floor.

A further object of this invention is to create a drink coaster which when utilized would create a safe environment

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE INVENTION

Like reference numbers will be used to refer to like parts from Figure to Figure in the following description of the preferred embodiment of the invention.

Figure 1:
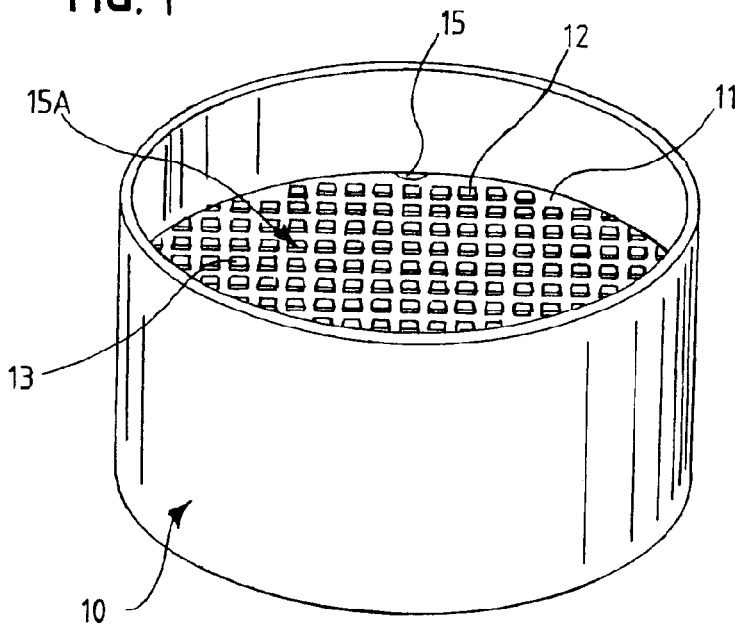
FIG. 1 is a perspective top view of the drink coaster.

A drink coaster 10 which incorporates this invention is shown in perspective in FIG. 1. The coaster has a cylindrical body with a floor 11 which acts as a separation member horizontally disposed in the cylindrical body of the coaster, dividing the interior of the cylinder into a top half 15A and a bottom half 15B. Floor 11 includes squares 12 which protrude into the top half 15A and form a flat surface inside the cylindrical body which holds the beverage container. Grooves 13 are formed between squares 12 for drainage. The grooves lead to four holes 14, 15, 16 and 17 adjacent to the squares and grooves are spaced around the outer edge of floor 11 to prevent liquid buildup.

Figure 2:
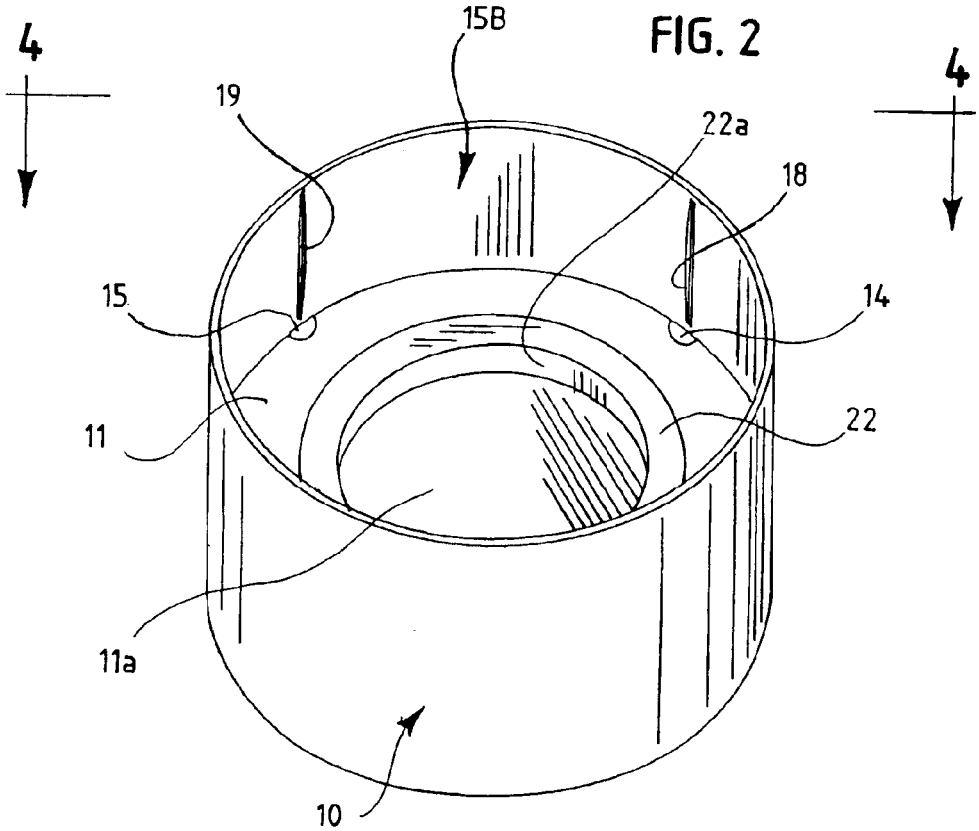
FIG. 2 is a perspective bottom view of the drink coaster of FIG. 1.
Figure 3:
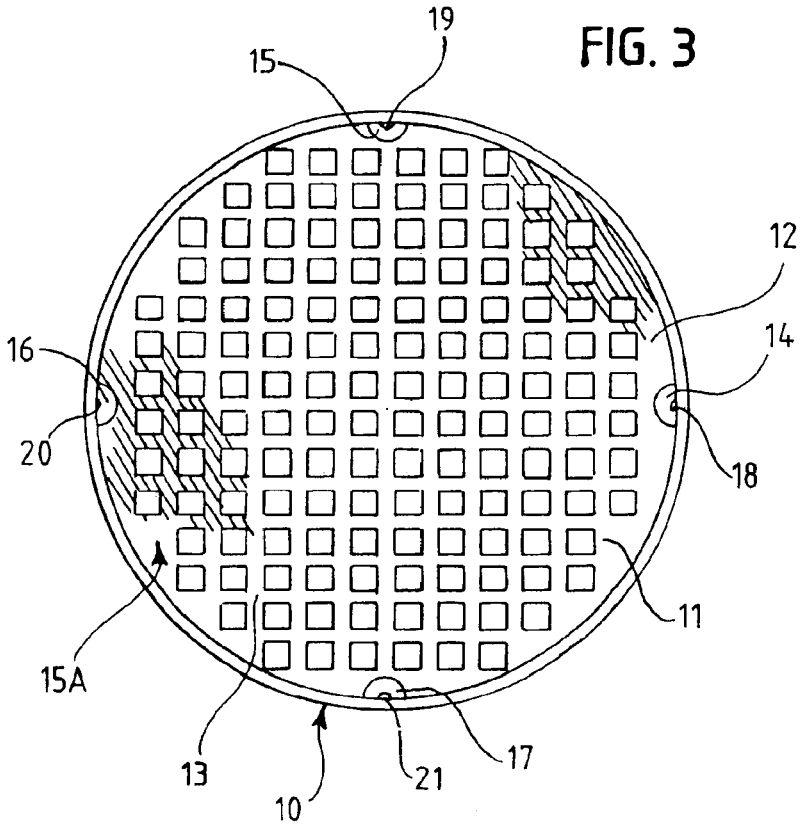
FIG. 3 is a top view of the drink coaster of FIG. 1.

FIG. 2, which is a perspective bottom view of the drink coaster 10, visually depicts the configuration of the inside of the bottom half 15B of the drink coaster 10 and illustrates that downwardly facing socket portion of the coaster. Four ribs 18, 19, 20 and 21 are arranged equidistantly from each other around the interior wall surface of bottom half 15B of the cylindrical coaster body and extend toward the interior of the cylinder. The ribs are also positioned so that they extend lengthwise most of the distance from the bottom surface of floor 11 to the outer end of the bottom half 15B of the cylindrical body of coaster 10. They are also formed so that their inner extremities which are spaced inwardly from the cylinder walls will frictionally engage the side surfaces of a urnal flushing device discussed hereinafter.

Figure 4:
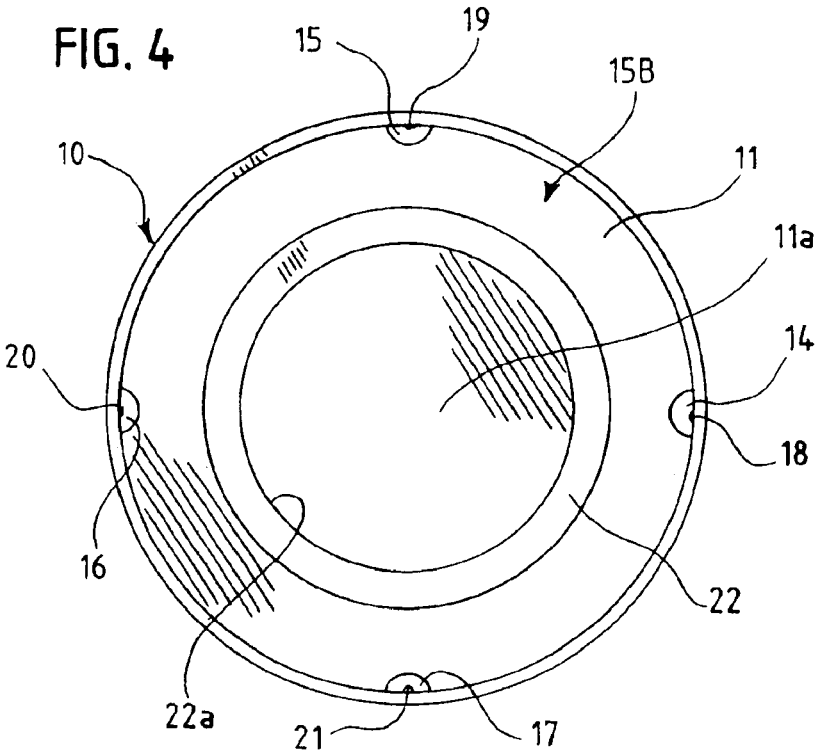
FIG. 4 is a bottom view of the drink coaster of FIG. 2.
Figure 5:
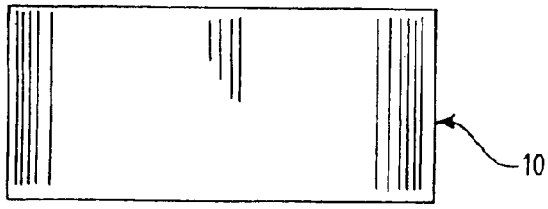
FIG. 5 is an elevational side view of the drink coaster of FIG. 1 the opposite side elevational view being a mirror image thereof.
Figure 6:
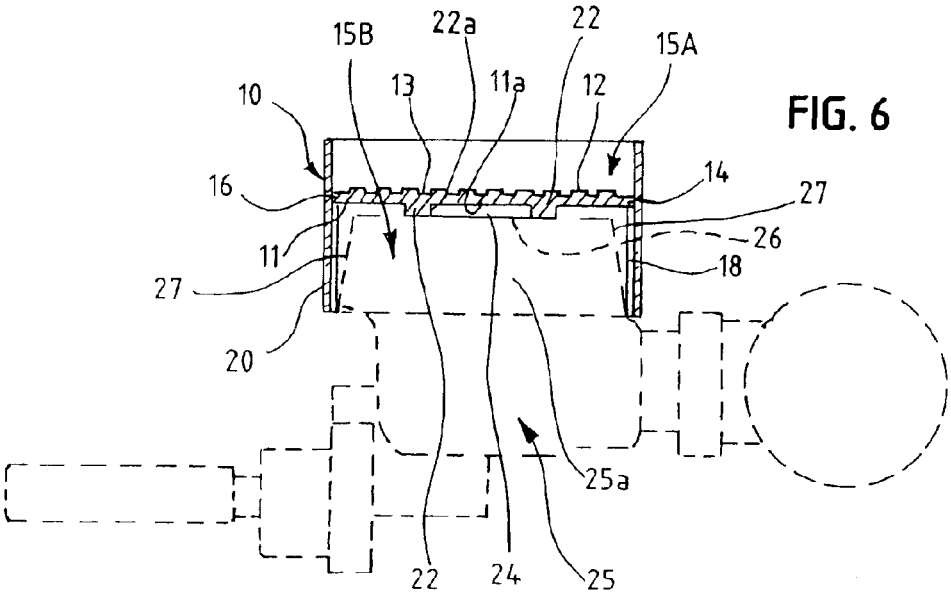
FIG. 6 is a cut-away view of the drink coaster of FIG. 5.
Figure 7:
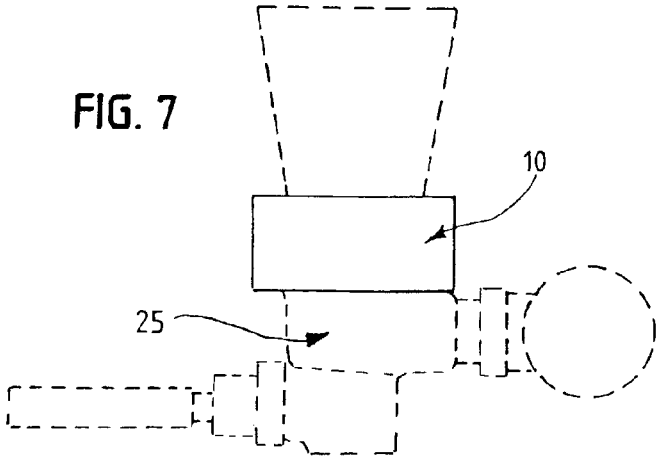
FIG. 7 is a side view of the drink coaster of FIG. 1 as it would typically appear during usage, the opposite side elevational view being a mirror image thereof.

In FIG. 4, which is a plan view of the bottom half 15B of the coaster body and further illustrates the downwardly facing socket portion of the coaster, a circular flange such as ring 22 protrudes from the bottom side of floor 11. The inner wall of ring 22 forms an engagement surface 22*a* of the ring for grasping a nut on top of an upper portion of the urinal flushing device 25, shown in phantom, with the drink coaster 10 attached to it. The flushing device is a conventional one with a cap 25*a* affixed to a variety of known plumbing connections below it. A nut 24 disposed on the top surface 26 of cap 25*a* holds the cap 25*a* in place. A skirt which forms side edges 27 of the cap 25*a* extends downwardly from the outer edges of the top surface 26 of cap 25*a*. It will be evident from FIG. 6 that the drink coaster 10 is attached to the flushing device 25 by placing the bottom half 15B of the coaster 10 over the cap 25*a* of the flushing device 25 and then merely pressing down on the coaster. The four ribs 18. 19, 20 and 21 frictionally engage the side edges 27 of the cap 25*a*, creating a snug fit between the ribs and the edges 27 of the cap. Almost simultaneously, the engagement surface 22*a* inside ring 22 grasps the edges of nut 24 in a snug fit. A central portion 11*a* of the underside of floor 11 inside ring 22 comes to rest upon and engages the top surface of nut 24. Together, the central portion 11*a* of the underside of floor 11 and the engagement surface 22*a* inside ring 22 cooperate with the ribs 18, 19, 20 and 21 to hold coaster 10 levelly and securely into the cap 25*a* of the flushing device 25.

The top half 15A of the drink coaster 10 is also served by the floor 11. As noted previously, floor 11 includes a pattern of raised squares 12 which extend upwardly inside the drink coaster body and form a surface for a drink container to rest upon. The grooves formed between the squares allow floor 11 to be drained through holes 14, 15, 16 and 17, and accordingly, there is no collection of liquid around the base of the bottle, glass or can.

The coaster 10 is conveniently sized to fit the base of a bottle, glass or can, and it is a one-piece construction which can be readily molded. It is portable and thus can be placed in a stack on a table where a patron can pick one up and carry it with him. Its use is easily understood, requires no tools or assembly to frictionally engage it onto the top of the urinal flushing device or remove it, and is so inexpensive that the cost of loss or breakage of even a few coasters is negligible. In fact if some form of advertising is place on the outside, giving the coasters away could be encouraged.

It is evident from the foregoing disclosure that even though particular forms of the invention have been illustrated and described, still, various modifications can be made without departing from the true spirit and scope of the invention. Accordingly, no limitation on the invention is intended by the foregoing description of its preferred embodiments, and its scope is covered by the following claims.

I claim:

1. A urinal drink coaster for holding a container, securing said drink coaster on a urinal flushing device, said drink coaster comprising:

a cylinder configuration with a horizontal separation dividing the cylinder in half forming a base where said flushing device rest on, and said horizontal separation top has raised squares where container rest on, said horizontal separation has grooves along side raised squares for drainage of excess liquid from container, and said grooves lead to four evenly spaced hole on horizontal separation also for drainage of excess liquid, and said drink coaster further comprises, bottom half of cylinder which fits over flushing device secured by four ribs, and said four ribs evenly spaced raised and extended vertically from the interior wall of cylinder, and said four ribs snug fit along the outside surface of the flushing device securing the drink coaster, and said drink coaster further comprising a circular flange on the bottom of the horizontal separation which fits around a nut of the flushing device creating a level and snug fit along with the fbur ribs that run along the side of the flushing device.

2. A urinal drink coaster for holding a drink container securely on top of a urinal flushing device comprising:

a cylinder member having peripheral walls, a horizontal separation member joined inside the cylinder to the walls and having an upwardly facing surface and a downwardly facing surface, said horizontal separation member dividing the cylinder into a top half upwardly facing drink container holding portion and a bottom half downwardly facing socket portion, ribs extending from the peripheral walls of the cylinder toward the interior of the cylinder for snugly fiting along the outside surfaces of the urinal flushing device, and a circular flange on the downwardly facing surface of the horizontal separation member for snugly fitting around a nut on top of the urinal flushing device and creating a level and snug fit of the coaster on the urinal flushing device along with the ribs.

3. The urinal drink coaster of claim 2 in which the downwardly facing socket portion includes a circular flange having inwardly facing walls forming a circular socket for engaging the nut on top of the urinal flushing device with the inwardly facing flange walls.

4. The urinal drink coaster of claim 2 which the downwardly facing socket portion includes a central portion of the downwardly facing surface of the horizontal separation member within the circular flange formed for engagement with the top of the nut on top of the urinal flushing device when the ribs and circular flange of the coaster are pressed onto the urinal flushing device.

* * * * *